United States Patent [19]

Sedenquist, Sr.

[11] 4,138,631

[45] Feb. 6, 1979

[54] DROP WIRE CIRCUIT TESTER

[75] Inventor: John C. Sedenquist, Sr., Shawmut, Ala.

[73] Assignee: West Point Pepperell, Inc., West Point, Ga.

[21] Appl. No.: 862,909

[22] Filed: Dec. 21, 1977

[51] Int. Cl.[2] ..... H02P 3/00

[52] U.S. Cl. ..... 318/490; 307/119; 324/51; 200/61.18

[58] Field of Search ..... 318/490; 307/119; 324/51; 340/514, 515; 200/61.18

[56] References Cited

U.S. PATENT DOCUMENTS

| | | | |
|---|---|---|---|
| 2,712,676 | 7/1955 | McIntyre | 200/61.18 |
| 3,159,123 | 12/1964 | Godwin et al. | 200/61.18 |
| 3,735,147 | 5/1973 | Kryszek | 307/119 |
| 4,041,380 | 8/1977 | Epstein | 324/51 |
| 4,087,699 | 5/1978 | Marzoli | 200/61.18 |

*Primary Examiner*—Robert K. Schaefer
*Assistant Examiner*—M. K. Mutter
*Attorney, Agent, or Firm*—Cushman, Darby & Cushman

[57] ABSTRACT

An improved arrangement for testing the operability of drop wire circuitry associated with yarn handling equipment which does not require yarn movement to be interrupted during tests. A two-position switch operable between normal and test mode positions is included in the circuitry. A jack arrangement is rendered operable with the switch in the test position, thereby permitting an indicator to be selectively inserted in the drop wire circuitry path. The electrical characteristics of the indicator are such as to permit the indicator to be actuated when a drop wire falls while simultaneously disabling the normal response of the remaining drop wire circuitry. Means are provided to selectively bypass the indicator with the switch in the test position to thereby allow the drop wire circuitry to operate as if the switch were in the normal position.

5 Claims, 1 Drawing Figure

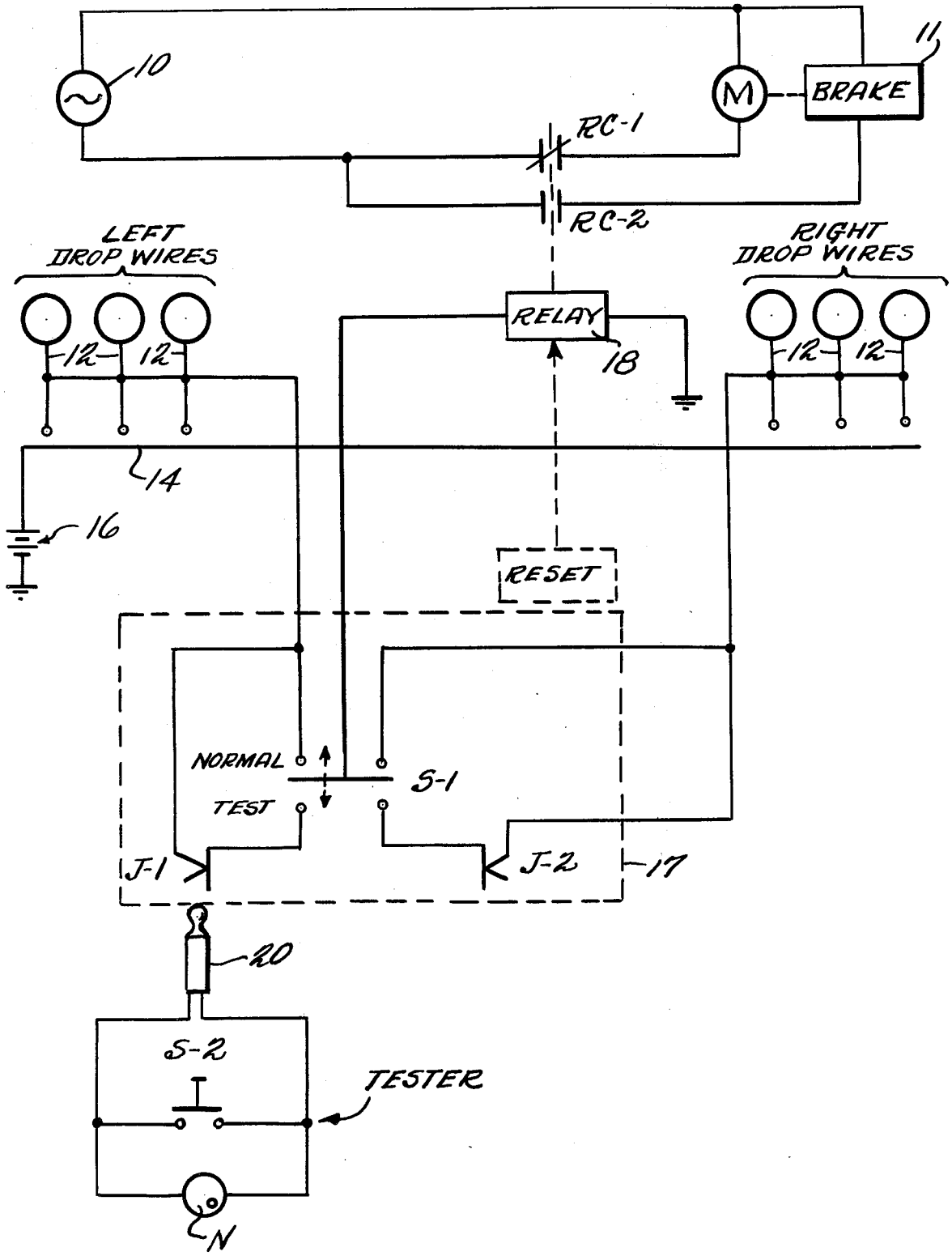
10
11
M
BRAKE
RC-1
RC-2
LEFT DROP WIRES
RIGHT DROP WIRES
RELAY
18
12
12
12
12
14
16
RESET
NORMAL
TEST
S-1
J-1
J-2
17
20
S-2
TESTER
N

DROP WIRE CIRCUIT TESTER

BACKGROUND OF THE INVENTION

The purpose of the invention is to facilitate the testing of devices which are called drop wires. In certain textile equipment such as creels and associated winders, lengths of yarn are run through drop wire elements. More particularly, such an element is a needle-like device formed of conductive material and having an eye at one end. The yarn passes through the eye and since the yarn is under tension, it serves to suspend its associated drop wire against gravitational force. However, should the yarn break, the drop wire falls to engage a bus which is connected to a power supply. A circuit is thereby completed from the power supply through the drop wire to a relay which, when energized, functions to interrupt a separate power supply to the winder motor and simultaneously closes a circuit between the separate power supply and an electromagnetic brake. The latter brings the motor to a quick stop. The operator then locates the broken length of yarn, repairs same, and restarts the operation.

Historically, a problem which has been encountered is that a drop wire may not be functioning properly to complete a circuit to the relay when the length of yarn associated with the drop wire breaks. Consequently, it is necessary to periodically check each of the drop wires to be sure that it is in operative condition. Obviously, this can be done in the manner described above, shutting down the winder for each test, but such a procedure is time-consuming, anti-productive, and causes unnecessary wear and tear on the electromagnetic braking system.

SUMMARY OF THE INVENTION

The purpose of the present invention is to provide a tester for drop wires which can be employed without interruption of the yarn handling operation. Such an arrangement reduces the time and manpower normally required for drop wire testing and promotes longer life for the braking device.

These advantages are accomplished by providing a switch in the drop wire circuitry path which is operable between normal and test mode positions. When in the latter position, a plug-in jack arrangement is introduced to the circuitry. The jack arrangement receives an indicator having electrical characteristics such that when a drop wire falls, the indicator responds but prevents sufficient current flow in the drop wire circuitry path to cause the winder motor to be shut down and the electromagnetic brake to be energized. Means are provided to short-circuit the indicator in the event that it is desired that the drop wire circuitry operate in a normal fashion with the switch in the test position.

Details of a preferred embodiment of the invention will become more apparent when considered in light of the accompanying schematic block drawing and the description now to be presented.

DETAILS OF THE INVENTION

Referring to the drawing, a motor M is illustrated which drives the yarn winder (not shown) for winding a number of lengths of yarn. The motor is energized from a power supply 10 through a normally closed relay contact RC-1. An electromagnetic brake 11 and a normally open relay contact RC-2 are connected in series across motor M and contact RC-1. The brake is operatively associated with motor M.

In the embodiment of the invention illustrated, two sets of drop wires 12 are provided — a left set and a right one. Each of the wires is shown in its normal position elevated above a conductive bus 14 joined to a D.C. power supply 16. The drop wires of each set are conductively joined to a respective contact associated with one position (designated as "normal") of a double-throw switch S-1. Additionally, the left drop wires are connected to a normally closed contact jack switch J-1, and the right drop wires are connected to a normally closed contact jack switch J-2. The switches J-1 and J-2 are connected to respective ones of the contacts associated with the other position (designated as "test") of switch S-1. The movable contact of S-1 is joined to a relay 18 which is operatively associated with relay contacts RC-1 and RC-2. The switches S-1, J-1 and J-2 may be conveniently packaged as indicated at 17.

When the switch S-1 is in the "normal" position, a series circuit is completed to ground from each drop wire through S-1 and relay 18. Thus, when any of the drop wires falls to engage the conductive bus 14, the relay is energized by power supply 16 to open RC-1 and close RC-2. As a result, the motor M is de-energized and is braked.

When it is desired to test the drop wires, switch S-1 is moved to the "test" position. Since J-1 and J-2 are normally closed, should any of the left drop wires fall, a circuit will be completed through J-1 and S-1 to energize the relay 18, thereby stopping motor M, as just described. Similarly, should one of the right drop wires fall, a path is completed through J-2 and S-1 to energize the relay, causing motor stoppage.

However, a tester is provided to check one set of drop wires (e.g., the left drop wire set) by disabling the direct path from these left drop wires through J-1 and S-1 to relay 18 without interrupting the path from the right drop wires through J-2 and S-1 to the relay. This is accomplished by a conventional telephone-type jack 20 which is inserted into jack switch J-1 to thereby introduce the tester between the contacts of J-1. This results in a neon lamp N being connected in series with the left drop wires, switch S-1 and the relay 18. The operator of the tester then may depress one of the left drop wires to engage bus 14. If proper contact is established, a circuit is completed from the D.C. power supply and the neon lamp N is lit, indicating proper operation of the drop wire circuit. However, the voltage drop across the lamp is sufficiently high as to prevent the relay 18 from being energized. Thus, motor M continues to operate. The checked drop wire is then returned to its original position out of contact with the conductive bus 14 and the remaining left drop wires are tested in a similar fashion.

In the event that a length of yarn associated with a left drop wire breaks while another drop wire of that set is being tested, the neon lamp remains illuminated after the examination of the drop wire being checked is completed. Should persistent illumination occur, the operator depresses switch S-2 of the tester, which is connected in parallel with lamp N. The lamp is thereby short-circuited to provide sufficient voltage to energize relay 18 so as to shut down the motor M.

Of course, if a drop wire in the right set should fall while the wires of the left group are being tested, the relay 18 will be energized to stop motor M inasmuch as power will be supplied to the relay through J-2 and S-1.

The procedure for testing the drop wires of the right set is identical to that just described except that the telephone-type jack 20 of the tester is inserted into jack switch J-2.

After the relay 18 has been energized to shut down the motor M, the operator attends to the usual repair of the broken yarn leading to the motor stoppage. It is necessary at this time to restore the motor to its normal operating condition, and for this purpose a reset arrangement is illustrated in the drawing to insure that the relay and its associated contacts RC-1 and RC-2 are in normal conditions.

While the drop wires in the illustrative embodiment were divided into two sets, it is apparent that by employing only one jack-switch, or more than two with a suitable number of contacts in S-1, the drop wires can be divided into any desired number of sets.

The arrangement just described can easily and inexpensively be adapted to existing yarn handling equipment in order to achieve the advantages of improved drop wire testing previously cited.

What is claimed is:

1. An improved arrangement for testing the operability of drop wires associated with motor operated yarn handling equipment, including:

a first power supply for energizing said motor;

relay contact means for connecting said power supply to the motor in accordance with the condition of said relay contact means; and drop wire circuitry, said circuitry including a second power supply, a conductive bus joined to the second supply, and a relay operatively associated with the drop wires whereby when at least one of said drop wires electrically engages the bus, a circuit is completed from the second power supply to energize the relay; the improvement comprising:

a first switch operable between normal and test positions, said switch in the normal position connecting said drop wires to the relay;

normally closed contact jack switch means joined to said drop wires and said first switch whereby when said first switch is in the test position, said drop wires are connected through the jack switch contacts to said relay; and a tester device including a jack adapted to engage the jack switch means to open its contacts, said tester further comprising indicator means electrically connected across the jack switch contacts when said jack engages the jack switch so as to be energized when a drop wire engages the bus.

2. A drop wire testing arrangement as set forth in claim 1, wherein said indicator means, when energized, develops a voltage drop sufficiently large to prevent actuation of said relay.

3. A drop wire testing arrangement as set forth in claim 2, wherein said tester device further comprises an additional switch connected in parallel with the indicator means and selectively operable to short circuit the indicator.

4. A drop wire testing arrangement as set forth in claim 1:

wherein said first switch includes a plurality of fixed contacts engaged by a movable contact in the normal position and a plurality of fixed contacts engaged by the movable contact in the test position;

wherein said drop wires are arranged in sets, the drop wires of each set being connected to respective ones of the fixed contacts associated with said normal position and being connected through a respective jack switch means to corresponding ones of the fixed contacts associated with said test position; and wherein said movable contact is electrically connected to the relay.

5. A drop wire testing arrangement as set forth in claim 4:

wherein said indicator means, when energized, develops a voltage drop sufficiently large to prevent actuation of the relay; and wherein said tester device further comprises an additional switch connected in parallel with the indicator means and selectively operable to short circuit the indicator.

* * * * *